US005564704A

United States Patent [19]

Yang

[11] Patent Number: 5,564,704

[45] Date of Patent: Oct. 15, 1996

[54] PAPER FOLDING GAME FOR SPATIAL PUZZLE

[76] Inventor: Ju-Hsun Yang, 58, Ma Yuan West St., Taichung, Taiwan

[21] Appl. No.: 458,118

[22] Filed: Jun. 5, 1995

[51] Int. Cl.[6] ..... A63F 9/08

[52] U.S. Cl. ..... 273/155; 273/153 R

[58] Field of Search ..... 273/155, 153 R, 273/157 R, 159; 446/487; 434/172; 40/446, 529

[56] References Cited

U.S. PATENT DOCUMENTS

| | | | |
|---|---|---|---|
| 847,545 | 3/1907 | Braine | 273/155 |
| 2,327,875 | 8/1943 | Edborg | 273/155 |
| 2,333,569 | 11/1943 | Higgins | 273/155 |
| 4,465,467 | 8/1984 | Exelby | 273/155 |
| 5,445,380 | 8/1995 | Polsky | 273/155 |

OTHER PUBLICATIONS

Games, "Greased Lightning", pp. 50 and 64.

*Primary Examiner*—Steven B. Wong

[57] ABSTRACT

A paper folding game includes a sheet of paper divided into twelves squares by a number of folding lines and arranged in a three by four matrix. Four groups of patterns are printed on the upper surfaces and the bottom surfaces of the squares. Six cut lines are arranged in the paper sheet so as to allow the paper sheet to be folded to a cubical shape. The four groups each includes six patterns that may be folded to the six outer surfaces of a cube.

2 Claims, 6 Drawing Sheets

PAPER FOLDING GAME FOR SPATIAL PUZZLE

BACKGROUND OF THE INVENTION

1. Field of the Invention

The present invention relates to a paper folding game, and more particularly to a paper folding game that may be folded to form a cubical puzzle.

2. Description of the Prior Art

Typical paper folding games comprise a sheet of paper having a number of folding lines formed therein for dividing the sheet of paper into a number of squares and having both sides printed with various kinds of patterns. However, the paper may be folded into a plane only.

The present invention has arisen to mitigate and/or obviate the afore-described disadvantages of the conventional paper folding games.

SUMMARY OF THE INVENTION

The primary objective of the present invention is to provide a paper folding game which can be folded to a spatial configuration so as to form a spatial folding puzzle.

In accordance with one aspect of the invention, there is provided a paper folding game comprising a sheet of paper including a plurality of folding lines provided therein so as to divide the paper sheet into twelves squares, the squares each including an upper surface and a bottom surface and the squares being arranged in a matrix including three rows having a first row, a second row and a third row, and four columns, a first cut line provided between a second and a third squares of the first row, a second cut line provided between a first square of the first row and a first square of the second row, a third cut line provided between the first square of the second row and a first square of the third row, a fourth cut line provided between a second and a third squares of the third row, a fifth cut line provided between a fourth square of the third row and a fourth square of the second row, and a sixth cut line provided between a fourth square of the first row and the fourth square of the second row, and four groups of patterns being provided on the upper surfaces and the bottom surfaces of the squares.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
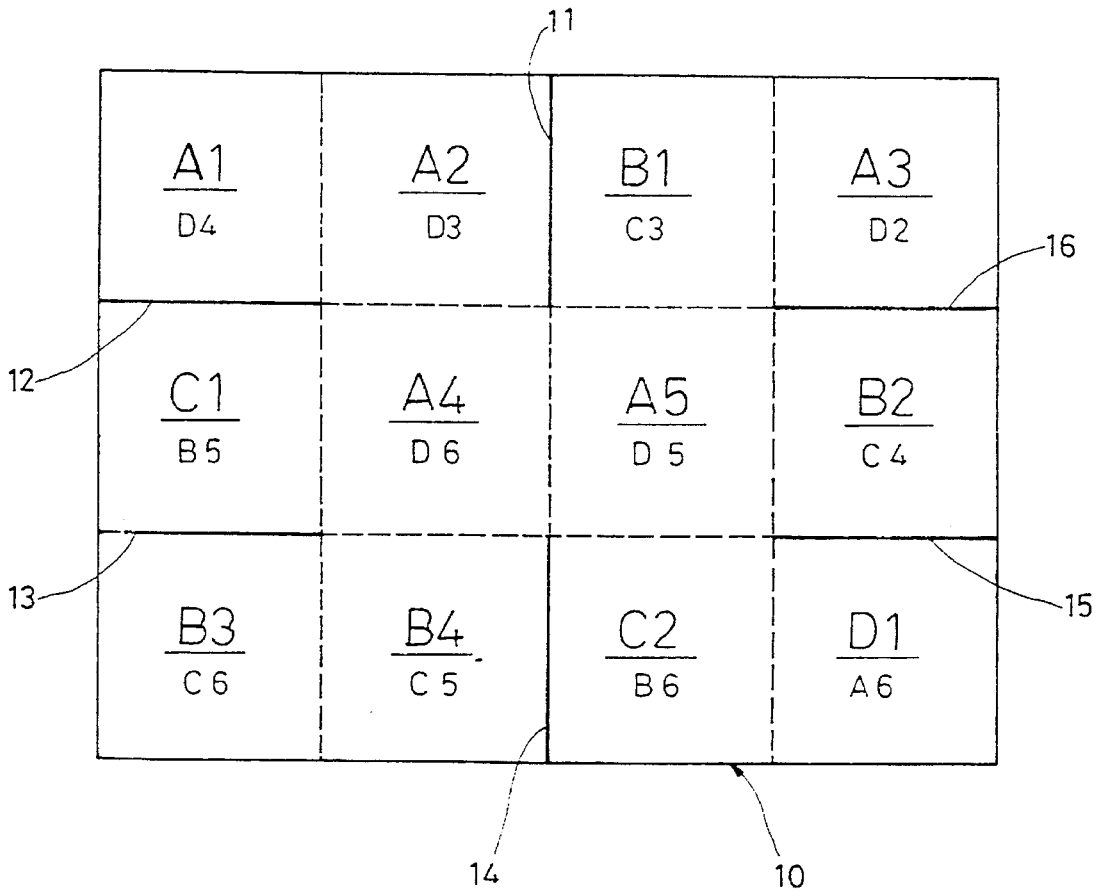
FIG. 1 is a top plane view of a paper folding game in accordance with the present invention.
Figure 2:
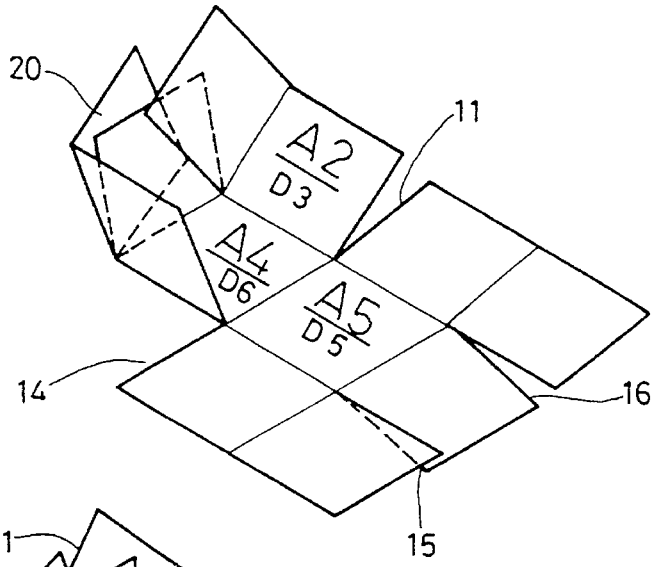
FIGS. 2, 3 and 4 are perspective views illustrating the operation of the paper folding game.
Figure 3:
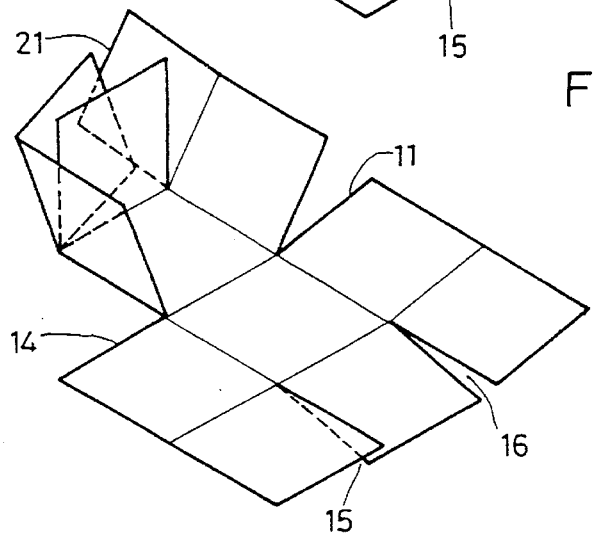
Figure 4:
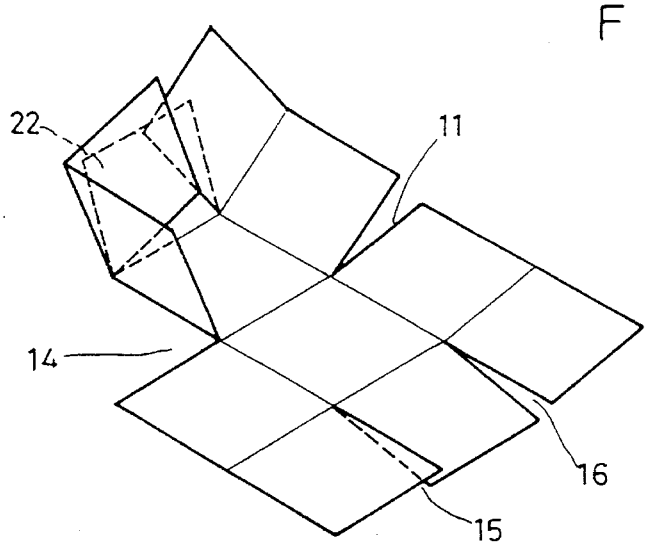

Referring to the drawings, and initially to FIGS. 1 to 4, a paper folding game in accordance with the present invention comprises a sheet of paper 10 provided with a number of folding lines so as to divide the paper sheet 10 into twelves squares arranged in a 3 by 4 matrix which includes three rows and fur columns. Two cut lines 11, 14 are provided between the second and the third squares of the first row and of the third row respectively. Two cut lines 12, 13 are provided between the first, the second and the third squares of the first column respectively; and two cut lines 15, 16 are provided between the first, the second and the third squares of the fourth column respectively. The twelves squares each includes an upper surface and a bottom surface printed with four groups of patterns. The four groups of patterns include A1, A2, A3, A4, A5, A6; B1–B6; C1–C6; and D1–D6.

Referring again to FIG. 1, illustrated is one example of the paper folding game. The patterns A1, A2, B1 and A3 are provided in the upper surfaces of the first row of the squares. The patterns C1, A4, A5 and B2 are provided in the upper surfaces of the second row of the squares. The patterns B3, B4, C2 and D1 are provided in the upper surfaces of the third row of the squares. The patterns D2, C3, D3 and D4 are provided in the bottom surfaces of the first row of the squares. The patterns C4, D5, D6 and B5 are provided in the bottom surfaces of the second row of the squares. The patterns A6, B6, C5 and C6 are provided in the bottom surfaces of the third row of the squares.

Referring again to FIGS. 2 to 4, any of the three squares 20, 21, 22 of the first column may be folded to the outermost position relative to the other two squares. Similarly, any of the three squares of the fourth column may be folded to the outermost position relative to the other two squares. Either of the second and the third squares of the first row may be folded to the outer portion relative to the other square; and either of the second and the third squares of the third row may be folded to the outer portion relative to the other square.

Figure 5:
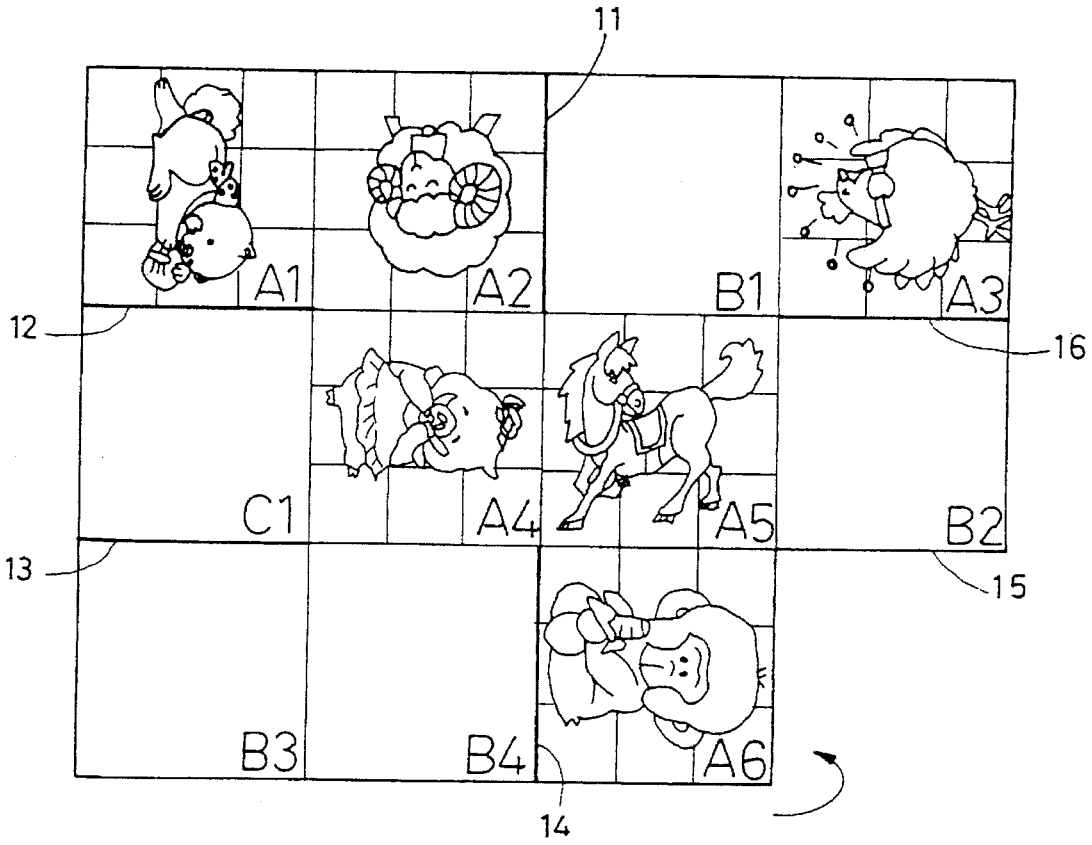
FIGS. 5, 7, 9, 11 are plane views illustrating four groups of patterns of the paper folding game.
Figure 6:
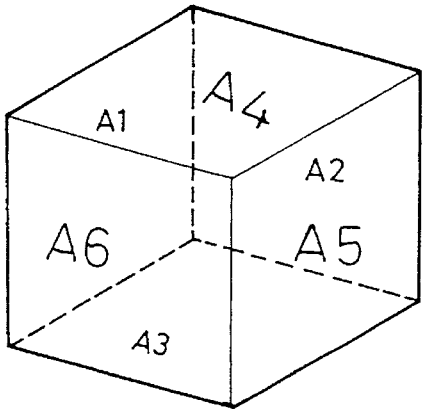
FIGS. 6, 8, 10, 12 are perspective views illustrating the spatial puzzle folded by the groups of patterns as shown in FIGS. 5, 7, 9, 11 respectively.

Referring next to FIGS. 5 and 6 and again to FIG. 1, the fourth square of the third row is folded to engage with the third square of the third row so as to reveal the pattern A6 on the bottom surface of the fourth square of the third row. The group of patterns A1–A6 may thus be folded to a cubical configuration as shown in FIG. 6.

Figure 7:
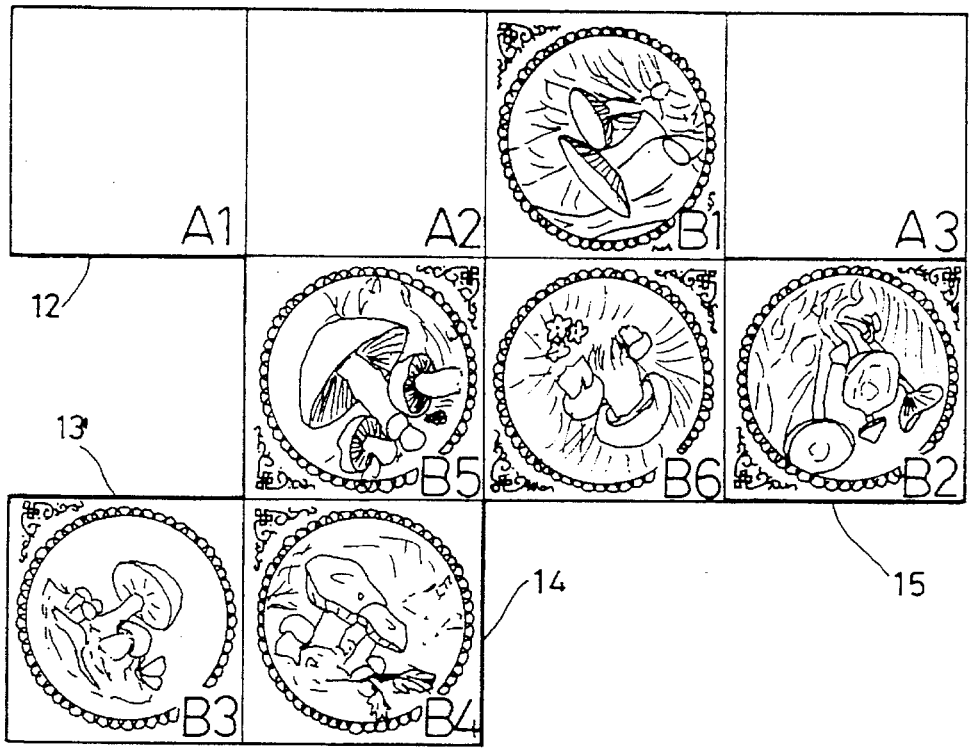
Figure 8:
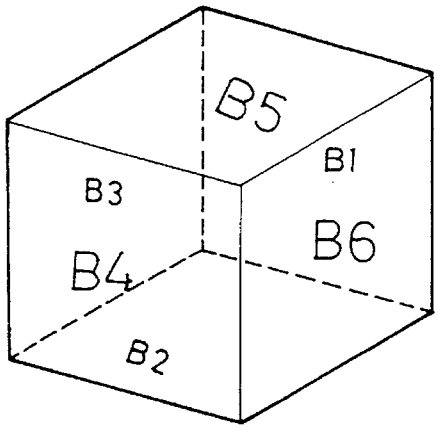

Referring next to FIGS. 7 and 8 and again to FIG. 1, the fourth square of the third row is first folded to engage with the third square of the third row and the third square of the third row is then folded to engage with the third square of the second row so as to reveal the pattern B6 on the bottom surface of the third square of the third row. The first square of the second row is folded to engage with the second square of the second row so as to reveal the pattern B5 on the bottom surface of the first square of the second row. The group of patterns B1–B6 may thus be folded to a cubical configuration as shown in FIG. 8.

Figure 9:
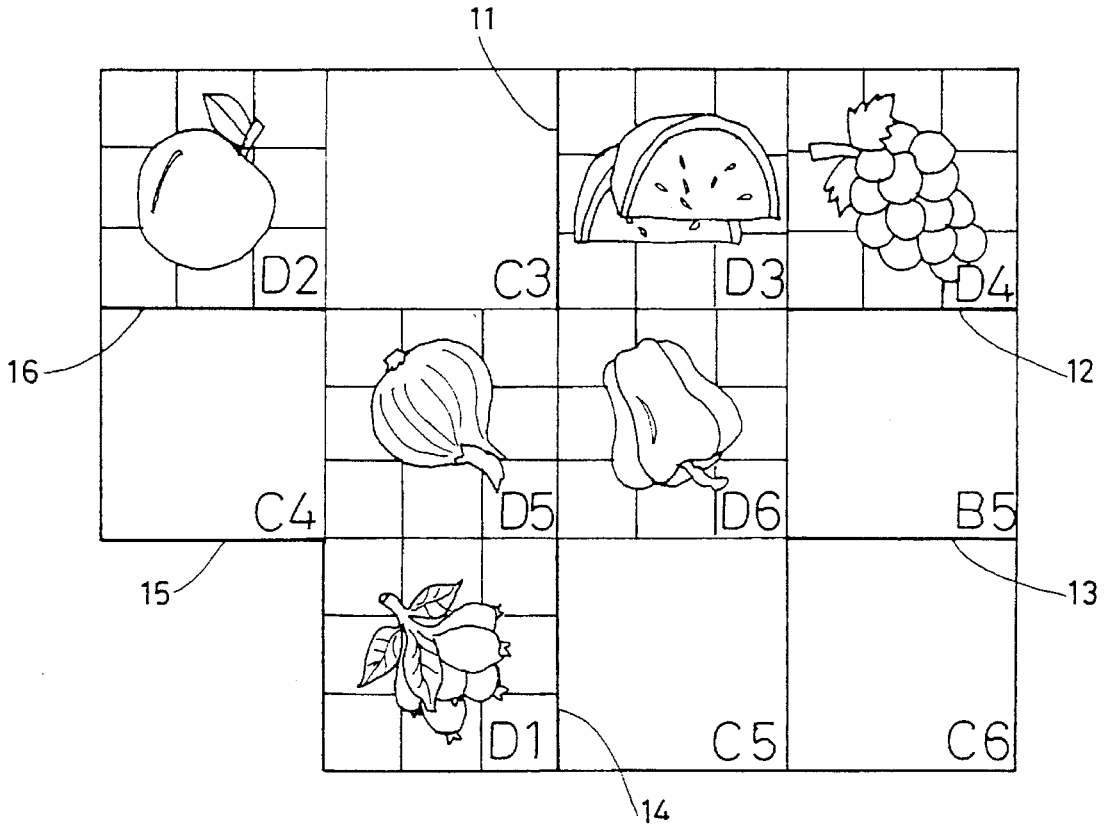
Figure 10:
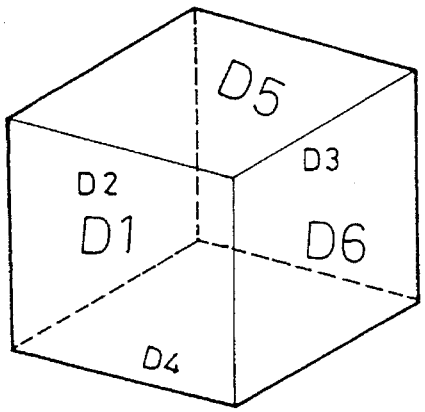

Referring next to FIGS. 9 and 10 and again to FIG. 1, when the paper sheet is disposed up side down relative to the paper sheet as shown in FIG. 1, the first square of the third row is folded to engage with the second square of the third row so as to reveal the pattern D1 on the bottom surface of the first square of the third row. The group of patterns D1–D6 may thus be folded to a cubical configuration as shown in FIG. 10.

Figure 11:
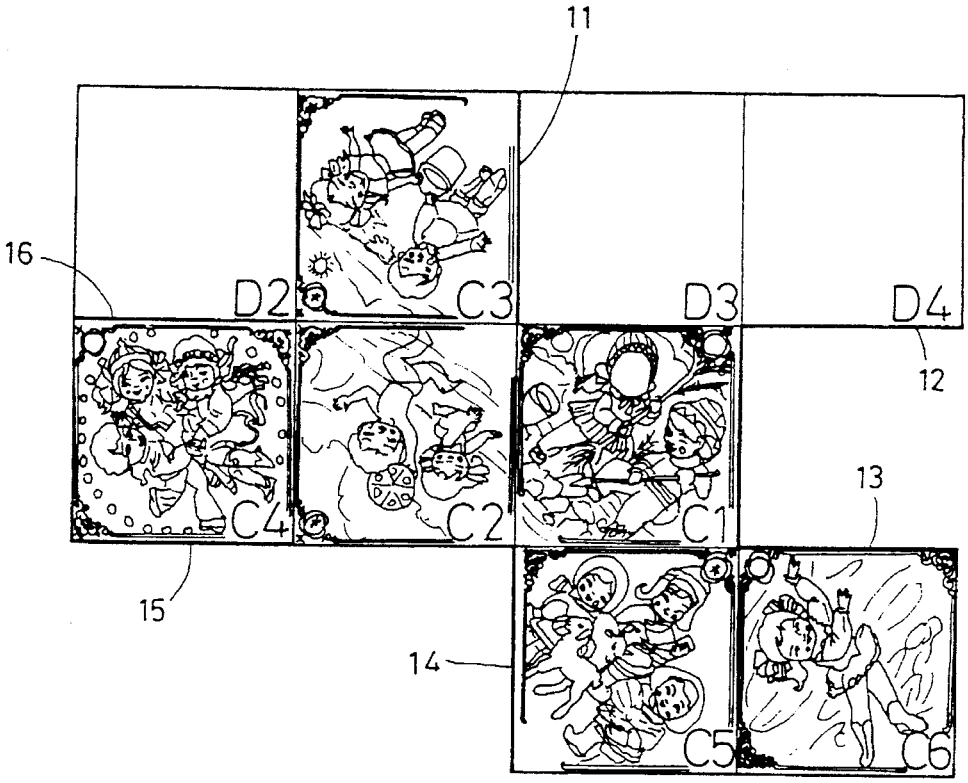
Figure 12:
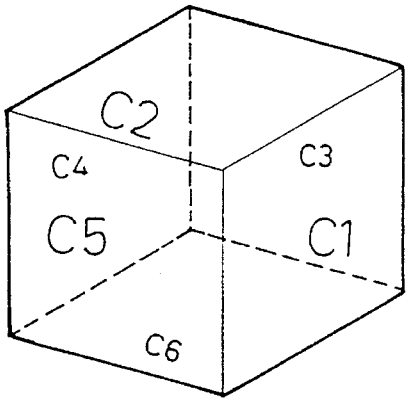

Referring next to FIGS. 11 and 12 and again to FIG. 1, when the paper sheet is disposed up side down relative to the paper sheet as shown in FIG. 1 the first square of the third row is first folded to engage with the second square of the third row and the second square of the third row is then folded to engage with the second square of the second row so as to reveal the pattern C2 on the bottom surface of the second square of the third row. The fourth square of the second row is folded to engage with the third square of the second row so as to reveal the pattern C1 on the bottom surface of the fourth square of the second row. The group of patterns C1–C6 may thus be folded to a cubical configuration as shown in FIG. 12.

Accordingly, the paper folding game in accordance with the present invention includes a sheet of paper having a number of cut lines formed therein so as to allow the paper sheet to be folded to a cubical puzzle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A paper folding game comprising:

a sheet of paper including a plurality of folding lines provided therein so as to divide said paper sheet into twelve squares, said squares each including an upper surface and a bottom surface and said squares being arranged in a matrix including three rows having a first row, a second row and a third row, and four columns, a first cut line provided between a second and a third squares of said first row, a second cut line provided between a first square of said first row and a first square of said second row, a third cut line provided between said first square of said second row and a first square of said third row, a fourth cut line provided between a second and a third squares of said third row, a fifth cut line provided between a fourth square of said third row and a fourth square of said second row, a sixth cut line provided between a fourth square of said first row and said fourth square of said second row, four groups of patterns being provided on said upper surfaces and said bottom surfaces of said squares, and wherein the six cut lines are arranged so as to allow the paper sheet to be folded into a cubic shape and wherein each group may be folded to the outer surface of the cube.

2. A paper folding game comprising:

a sheet of paper including a plurality of folding lines provided therein so as to divide said paper sheet into twelve squares, said squares each including an upper surface and a bottom surface and said squares being arranged in a matrix including three rows having a first row, a second row and a third row, and four columns, a first cut line provided between a second and a third squares of said first row, a second cut line provided between a first square of said first row and a first square of said second row, a third cut line provided between said first square of said second row and a first square of said third row, a fourth cut line provided between a second and a third squares of said third row, a fifth cut line provided between a fourth square of said third row and a fourth square of said second row, a sixth cut line provided between a fourth square of said first row and said fourth square of said second row, four groups of patterns provided on said upper surfaces and said bottom surfaces of said squares and including a first group, a second group, a third group and a fourth group, said four groups each including six patterns, said first group of patterns being provided on said upper surfaces of said first, said second, and said fourth squares of said first row, a second and a third squares of said second row, and said bottom surface of said fourth square of said third row, said second group of patterns being provided on said upper surface of said third square of said first row, said fourth square of said second row, said first and said second squares of said third row, said bottom surface of said first square of said second row and said bottom surface of said third square of said third row, said third group of patterns being provided on said upper surface of said first square of said second row, said third square of said third row, said bottom surface of said third square of said first row, said bottom surface of said fourth square of said second row, said bottom surfaces of said first and said second squares of said third row, said fourth group of patterns being provided on said upper surface of said fourth square of said third row, said bottom surfaces of said first, said second and said fourth squares of said first row, and said bottom surface of said second and said third squares of said second row, and wherein the six cut lines are arranged so as to allow the paper sheet to be folded into a cubic shape and wherein each group may be folded to the outer surface of the cube.

* * * * *